US006640680B2

(12) United States Patent
Becan et al.

(10) Patent No.: US 6,640,680 B2
(45) Date of Patent: Nov. 4, 2003

(54) APPARATUS AND METHODS FOR SCULPTING CARPET

(75) Inventors: Andrew M. Becan, Scatington, PA (US); Jeffrey L. Fink, Birdsboro, PA (US)

(73) Assignee: Eagle Automation, Inc., Exton, PA (US)

( * ) Notice: Subject to any disclaimer, the term of this patent is extended or adjusted under 35 U.S.C. 154(b) by 0 days.

(21) Appl. No.: 10/295,170

(22) Filed: Nov. 15, 2002

(65) Prior Publication Data

US 2003/0066401 A1 Apr. 10, 2003

Related U.S. Application Data

(62) Division of application No. 09/237,526, filed on Jan. 27, 1999.

(51) Int. Cl.[7] ..... B26D 3/06

(52) U.S. Cl. ..... 83/20; 83/76.001; 83/558; 83/694; 83/940; 26/16

(58) Field of Search ..... 83/940, 941, 72, 83/20, 76.1, 694, 915, 751, 13, 19, 554, 556, 558; 26/15 R, 16

(56) References Cited

U.S. PATENT DOCUMENTS

| | | | | |
|---|---|---|---|---|
| 2,228,768 A | | 1/1941 | Jones | 30/41.6 |
| 2,810,954 A | | 10/1957 | Clark | 30/123.3 |
| 2,975,517 A | | 3/1961 | Brittain | 30/133 |
| 3,364,068 A | | 1/1968 | Stern | 134/22.18 |
| 3,988,828 A | | 11/1976 | Geary | 30/123.3 |
| 4,107,839 A | | 8/1978 | Jung | 30/123.3 |
| 4,512,077 A | | 4/1985 | Tanabe et al. | 30/41 |
| 4,654,969 A | | 4/1987 | Schwartzott | 30/275 |
| 4,793,033 A | | 12/1988 | Schneider et al. | 26/16 |
| 5,016,328 A | | 5/1991 | Gilpatrick | 26/7 |
| RE33,756 E | | 12/1991 | Carder | 30/216 |
| 5,285,558 A | | 2/1994 | Carder et al. | 26/7 |
| 5,653,025 A | | 8/1997 | Cheng et al. | 30/140 |
| 5,979,278 A | * | 11/1999 | Warthen et al. | 83/20 |

* cited by examiner

*Primary Examiner*—Kenneth E. Peterson
(74) *Attorney, Agent, or Firm*—Woodcock Washburn LLP

(57) ABSTRACT

Apparatus and methods for cutting carpet pile are disclosed as including a clipper having a driver, a reciprocating blade and a fixed blade. The fixed blade and the reciprocating blade define an area there between. The fixed blade has a bore passing through the blade and into the area. A fluid supply, connected to the bore, supplies fluid through the fixed blade and into the area. A manifold, attached to the fixed blade, can be used to pass fluid through the fixed blade into the chamber. In such an embodiment, the manifold includes a passage communicating with the bore and the fluid supply. In another embodiment, an orientation mechanism is used to orient the carpet clipping head. In this embodiment, the orientation mechanism includes a base bracket and a pivot bracket. The pivot bracket is pivotally attached to the base bracket at a pivot point. The carpet clipping head is attached to the pivot bracket so that movement of the pivot bracket causes the carpet clipping head to pivot about the lead prong. In yet another embodiment, the carpet trimmer is attached to a computer controlled carrier platform. In such an embodiment, the carpet trimmer is spaced from the point at which the clipping blade contacts the pile before cutting the pile. In yet another embodiment, a pile orientation member is provided for orienting pile in the path of the clipper head so that the pile is oriented in a plane substantially perpendicular to the cutting plane.

2 Claims, 5 Drawing Sheets

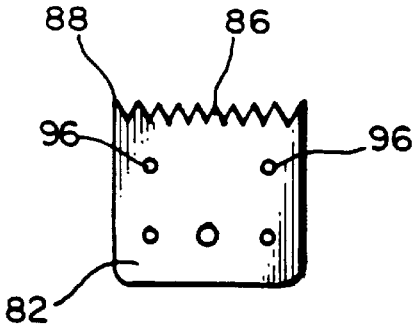
FIG. 7
FIG. 8
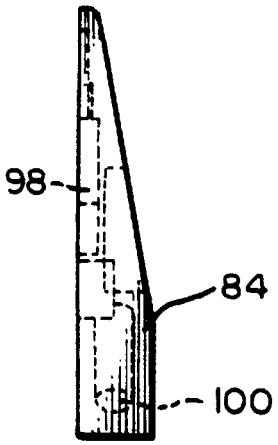
FIG.9
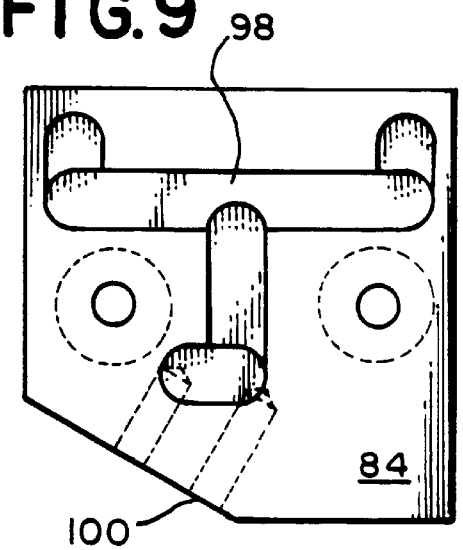
FIG. 10
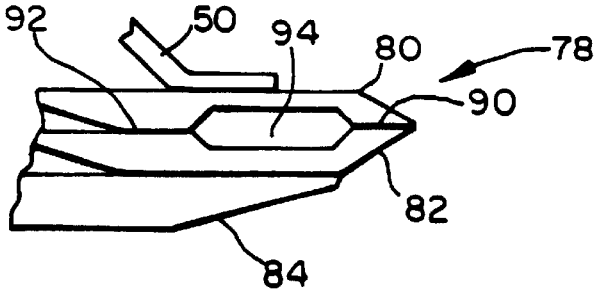

APPARATUS AND METHODS FOR SCULPTING CARPET

CROSS-REFERENCE TO RELATED APPLICATIONS

This application is a divisional of U.S. patent application Ser. No. 09/237,526, filed Jan. 27, 1999, still pending, and entitled "APPARATUS AND METHODS FOR SCULPTING CARPET", hereby incorporated by reference in its entirety.

FIELD OF THE INVENTION

The present invention relates to the field of carpet manufacture, and more particularly to methods and apparatus for sculpting patterns in carpet pile.

BACKGROUND OF THE INVENTION

As has been recognized in the past, designers and artisans have employed various design treatments with respect to carpeting used on both floors and walls. In particular, decorative designs have been sculpted in the carpet pile using hand-held electric or air powered carpet shears or clippers. In the past, to cut decorative designs in carpet pile, it had been suggested to use templates, to pre-mark the carpet and manually cut a pattern in the pile and to use automated, computer controlled cutting tables. Since sculptured effects can involve complex, intricate decorative designs, computer controlled equipment is preferred, not only for purposes of reliability and repeatability, but also to reduce the cost of having a highly skilled artisan engage in such a time consuming task.

One such computer controlled device, disclosed in U.S. Pat. No. 4,793,033—Schneider, et al. and incorporated herein by reference, includes a carriage mechanism adapted to move a clipping mechanism in two dimensions, i.e., to move the clipping mechanism in X and Y directions. This movement is said to be controlled by a computer having a memory into which desired patterns have been stored. In particular, the carriage mechanism includes a table on which a first pulley system moves a wheeled gantry-like structure in one direction and on which a second pulley system located on the gantry moves a wheeled platform in a second perpendicular direction. The clipping mechanism is said to be attached to the platform via a manually adjustable tripod mount which is said to permit variation of the angular orientation of the clipping mechanism. It is asserted that other disclosed mechanisms can move the clipping mechanism vertically as well as rotationally.

Unfortunately, such a computer controlled device suffers from several problems. First, because the clipping mechanism is moved via a tripod mount, setting or making changes to the angular orientation of the clipping blades will result in a relocation of the leading edge or leading prongs, i.e., the beginning cutting point will be offset from the pivot point in the mount. Since the angular setting or adjustment is manually achieved, it will be necessary, if even possible, to align/calibrate or re-align/calibrate the computer program and the clipper blades after each manual adjustment to allow for the relocation of the leading edge, so that the clipping blades cut in the exact locations specified by the computer. Second, because the device is automated, the clipping blades will be moving relative to one another for extended periods of time. The friction forces generated during the clipping operation will lead to elevated temperatures of the clipping blades. It has been found that such elevated temperatures cause the clipping blades to become dull faster, requiring replacement, thereby adding to the cost of operations. Although Schneider et al. suggests providing a lubricant drip to the blades and a vacuum operation, these features are not believed sufficient to maintain acceptable blade temperature for extended periods.

In addition, the Schneider et al. device does not account for pile deflection. It has been found that when a clipping mechanism is brought into contact with the carpet pile, the bottom of the clipping mechanism tends to compress or deflect the pile directly under the clipping blades. This deflection or compression can cause unwanted imperfections, i.e., tufts. Moreover, for direction changes where a clipping blade would be moved away from and then onto the pile, the tuft imperfection itself can be deflected or compressed, making matters worse. The presence of such tuft imperfections will require a manual finishing operation in order to achieve the desired appearance. Moreover, carpet pile over an extended area can have a random angle, bias or direction. During manual sculpting operations, the artisan will frequently brush the pile with a hand in order to orient the pile in a desired direction before clipping. The Schneider et al. device makes no mention, nor does it suggest a solution to this problem.

Although not resolving any of the above described problems, U.S. Pat. No. 5,285,558—Carder et al., incorporated herein by reference, discloses a hand operated device, containing a clipping mechanism, which is moved manually to trim carpet pile or to bevel the edge of the pile. In relation to the beveling operation, Carder et al. disclose a mounting bracket which permits pivoting of the clipping mechanism. Unfortunately, this pivoting movement also results in a relocation of the leading edge or leading prongs.

Additionally, the assignee of the present invention sells a carpet design and cutting system which incorporates a computer controlled cutting table. In this device, a desired pattern is entered into the computer and the computer causes the cutting table to cut the desired design into a piece of carpet held in place by a vacuum. Since this pattern cutting device has not heretofore been adapted to sculpt carpet, it too has not solved any of the above described problems.

Consequently, a need still exists for a carpet clipping device which controls clipping blade temperature during extended clipping operation, provides accurate angled orientation of the clipping blades, accounts for pile compression/deflection whenever the clipping blade is moved against the pile and which accounts for random pile direction.

SUMMARY OF THE INVENTION

It has been noted that many of the above described problems can be resolved and other advantages achieved in a carpet pile cutter which includes a clipper having a driver, a reciprocating blade and a fixed blade. The fixed blade and the reciprocating blade define an area there between. The fixed blade has a bore passing through the blade and into the area. A fluid supply, connected to the bore, supplies fluid through the fixed blade and into the area. A manifold, attached to the fixed blade, can be used to pass fluid through the fixed blade into the chamber. In such an embodiment, the manifold includes a passage communicating with the bore and the fluid supply.

In another embodiment, an orientation mechanism is used to orient the carpet clipping head. In this embodiment, the orientation mechanism includes a base bracket and a pivot bracket. The pivot bracket is pivotally attached to the base bracket at a pivot point. The carpet clipping head is attached to the pivot bracket so that movement of the pivot bracket causes the carpet clipping head to pivot about the lead prong. In such an embodiment, it is preferred for the base bracket to have a first pivot bore and for the pivot bracket to have a second pivot bore. It is especially preferred for the first and second pivot bores and the lead prong to lie substantially along a pivot axis. It is also preferred for the base bracket to include a threaded receptacle and for the pivot bracket to include an arcuate slot oriented to pass proximate the receptacle. In such an embodiment, a locking bolt is passed through the slot to engaging the receptacle and hold the pivot bracket in place by frictionally locking the pivot bracket to the base bracket.

In yet another embodiment, the carpet trimmer is attached to a computer controlled carrier platform. In such an embodiment, the carpet trimmer is spaced from the point at which the clipping blade contacts the pile before cutting the pile.

In a still further embodiment, a pile orientation member is provided for orienting pile in the path of the clipper head so that the pile is oriented in a plane substantially perpendicular to the cutting plane. In such an embodiment, the pile orientation member includes a friction engaging member for frictionally engaging and orienting the pile. The friction engaging member can take many forms such as a roller or belt arrangement rotating in a direction which urges the pile toward the clipper head.

BRIEF DESCRIPTION OF THE DRAWINGS

The present invention will be better understood and its numerous objects and advantages will become apparent by reference to the following detailed description of the invention when taken in conjunction with the following drawings, in which:

FIG. 7 is an isolated view of the fixed blade depicted in FIG. 4;

FIG. 8 is an isolated view of the manifold depicted in FIG. 4;

FIG. 9 is a plan view of the manifold depicted in FIG. 8;

FIG. 10 is a partial side elevation view of the clipping blades and manifold assembly;

DETAILED DESCRIPTION OF THE INVENTION

Figure 1:
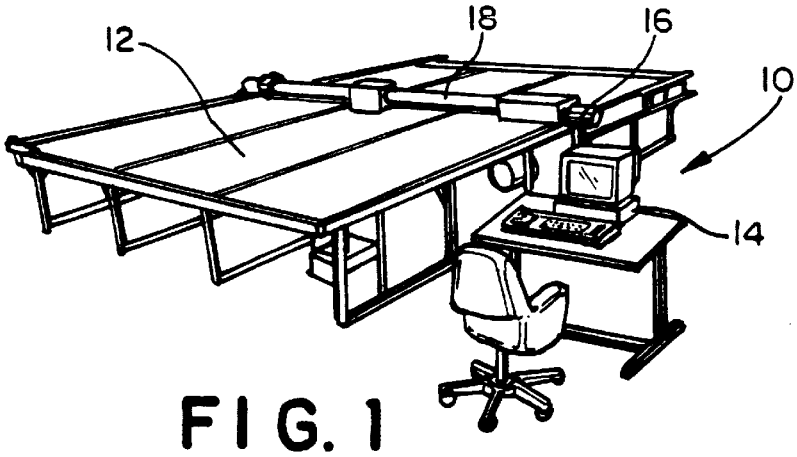
FIG. 1 is a perspective view generally depicting a carpet sculpting table constructed in accordance with the present invention.

A carpet pile cutting device 10, constructed in accordance with the present invention, is generally depicted in FIG. 1. As shown, device 10 includes a two axis positioning table 12 which is controlled by computer 14. Table 12 includes a first motor assembly 16 for moving bridge structure 18 along the length axis. A second motor 20 (shown in FIG. 2) moves a carrier platform across bridge structure 18, i.e., along the width axis. In this manner, motors 16 and 18 cause table 12 to act as an X-Y plotter, positioning the carrier platform at any desired X-Y coordinate. Because such motors and the computers and software for operating same are known, they will not be discussed in any greater detail herein. It is noted that computer 14 includes a memory sufficient to store those commands necessary to cause table 12 to move the carrier platform in a desired pattern.

It is preferred for table 12 to include an integral vacuum feature for holding carpet to be sculpted securely to table 12 during any such sculpting operation. Again because such vacuum feature is known from the cutting table product currently sold by the assignee of the present invention, it will not be described in any detail herein.

Figure 2:
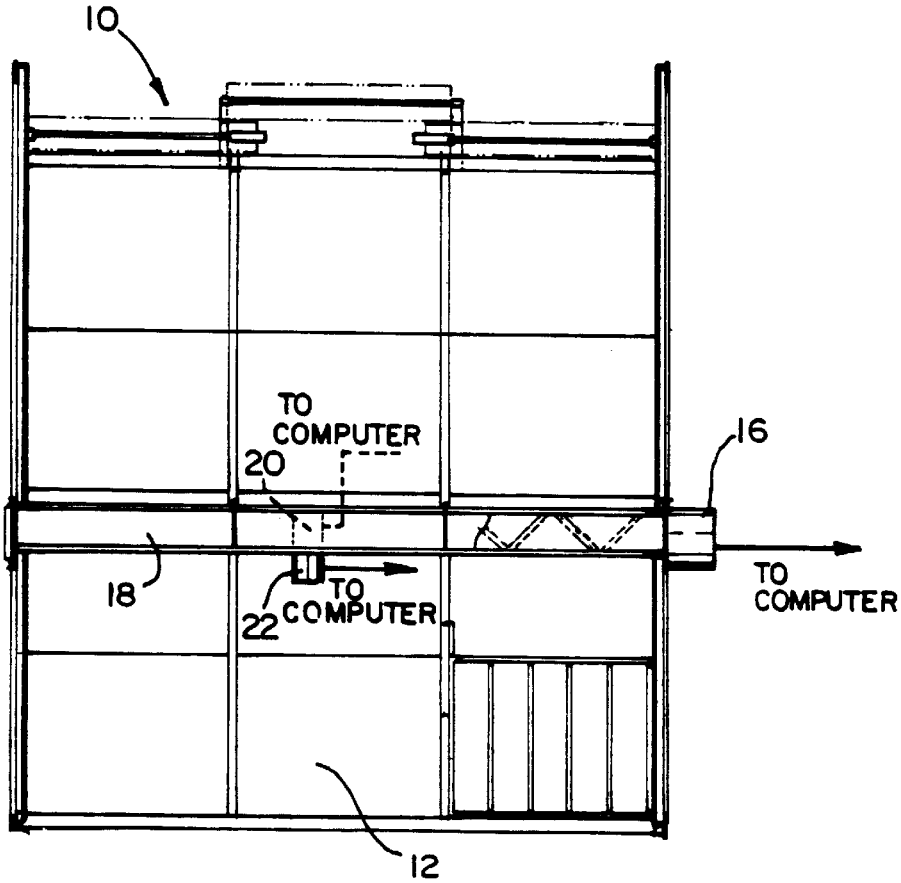
FIG. 2 is a plan view of the sculpting table depicted in FIG. 1.
Figure 3:
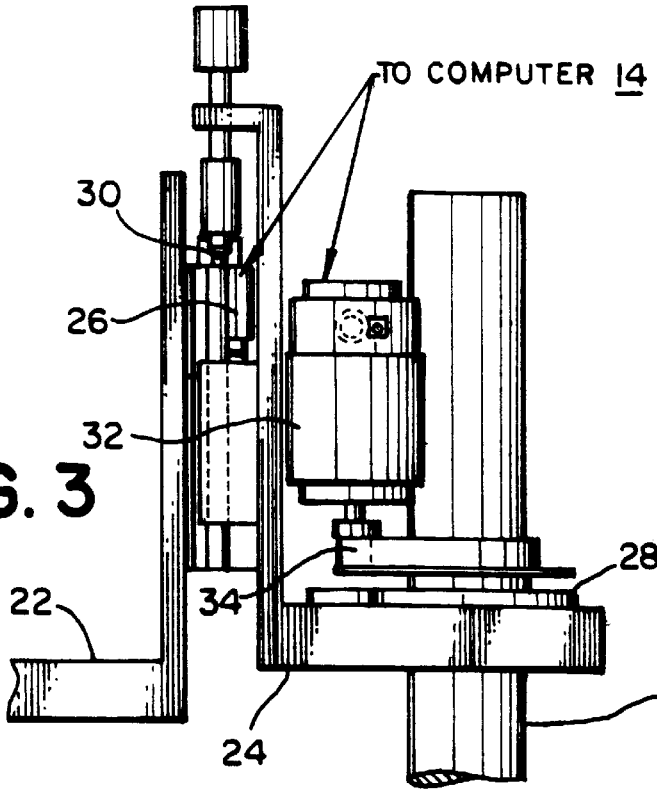
FIG. 3 is a side view of a tool platform attached to a carriage of the carving table of FIGS. 1 and 2.

Referring now to FIG. 2, table 12 is depicted from above. It will be appreciated that motor 20 serves to move carrier platform 22 across bridge 18, thereby traversing the width axis of table 12. The details of carrier platform 22 are depicted in FIG. 3 As shown in FIG. 3, carrier platform 22 includes base 24 to which piston assembly 26 is rotatingly attached via bearing assembly 28. Piston assembly 26 is attached so that rod 30 passes through as opening or bore in base 24. The movement of rod 30 is controlled by computer 14. As will be seen in connection with FIG. 4, movement of rod 30 causes the clipping mechanism to be moved toward or away from the carpet pile. Since no particular piston assembly is necessary to practice the invention, it is not further described. However, it is noted that any piston assembly selected must be capable of moving the clipping assembly and must be capable of reliable operation when subjected to rotational movement.

Piston assembly 26 is rotated by motor 32. Motor 32 is mechanically coupled to piston assembly 26 via assembly 34. Assembly 34 may include any appropriate gear or belt based mechanism by which the rotational movement of the shaft of motor 32 can be transmitted to the structure of piston assembly 26. Similar to motors 16 and 22, motor 32 is controlled by computer 14. Again, because such the positioning motors and the computers and software for controlling same are known, as evidenced by the previous description of prior devices, that subject will not be discussed in any greater detail herein. Similarly, the details necessary for generating a control signal sufficient to cause piston assembly 26 to move rod 30 should also be known.

Figure 4:
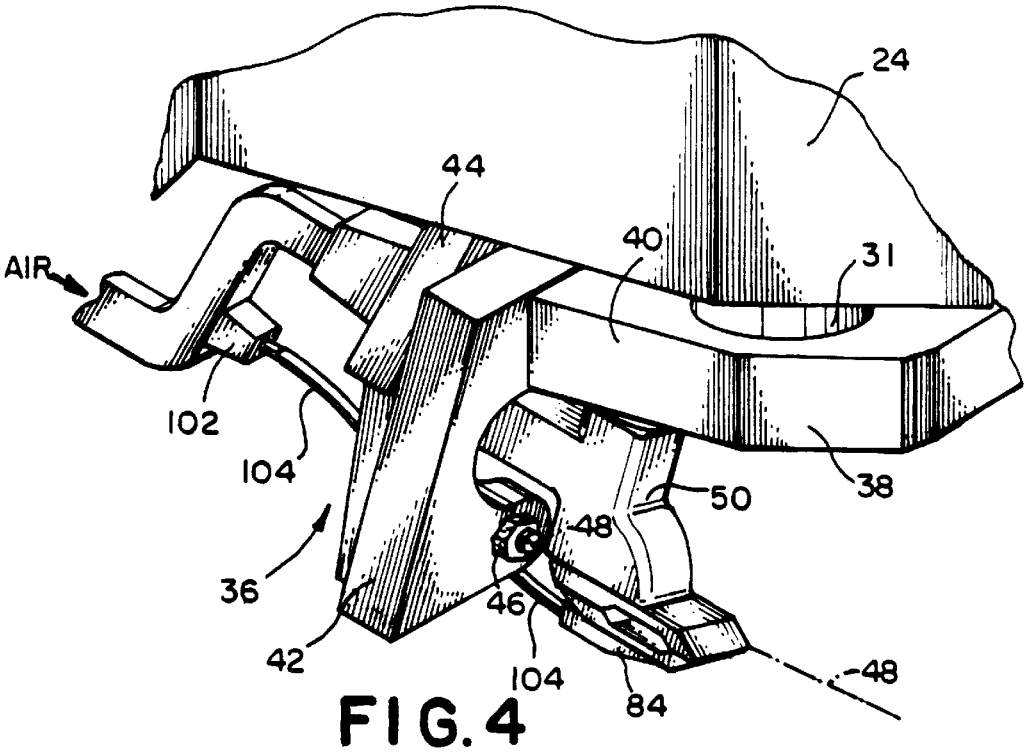
FIG. 4 is a diagrammatical perspective of a clipping head assembly constructed in accordance with the present invention.

Referring now to FIG. 4, clipping head assembly 36 will be described. Clipping head 36 is shown to be attached to rod 30. Consequently, operation of motor 32 will cause clipper head 36 to rotate. Likewise, movement of rod 30 will cause clipper head 36 to move towards and away from the carpet pile (not shown).

Clipper head 36 includes a base bracket 38, which in turn is formed from two members, namely rod connecting member 40 and a pivot connecting member 42. Bracket 44 is pivotally connected to member 42 via pivot connector 46. In the preferred embodiment, connector 46 is a nut and bolt assembly. Bracket 44 pivots about an axis 48, which axis passes through connector 46 and through the leading prong of the clipper blades. An air actuated clipping mechanism 50 is securely held by bracket 44. As will be appreciated from a description of FIGS. 5 and 6, pivotal movement of bracket 44 will result in movement of clipping mechanism 50.

However, unlike prior structures, because pivot axis 48 does not pass through the body of clipper mechanism 50, but rather, passes through the leading prong of the clipping blades, the leading prong will remain relatively stationary alleviating the necessity for any software modifications in the control of motors 16, 20 and 32.

Figure 5:
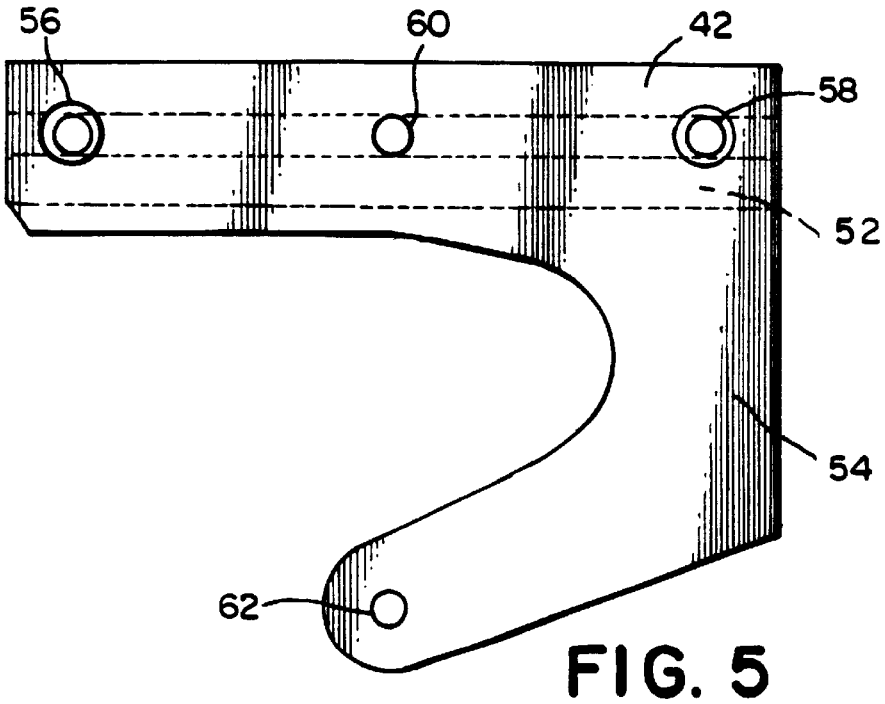
FIG. 5 is an isolated view of the base bracket depicted in FIG. 4.

Referring now to FIG. 5, member 42 will be described in greater detail. Member 42 generally includes two arms 52 and 54. Arm 52 is provided with two bores 56 and 58 for attaching member 42 to member 40. Such attachment can be by bolts, screws or any other suitable means. A further bore 60, preferably formed with threads or containing a threaded insert, thereby defining a threaded receptacle, functions to secure bracket 44 in a desired angular orientation. Arm 54 extends away from arm 52 thereby defining an area between the arms. Such area need be sufficient to permit the rotational movement clipper mechanism 50. A bore 62 is formed at the free end of arm 54. It is again noted that axis 48 passes through bore 62.

Figure 6:
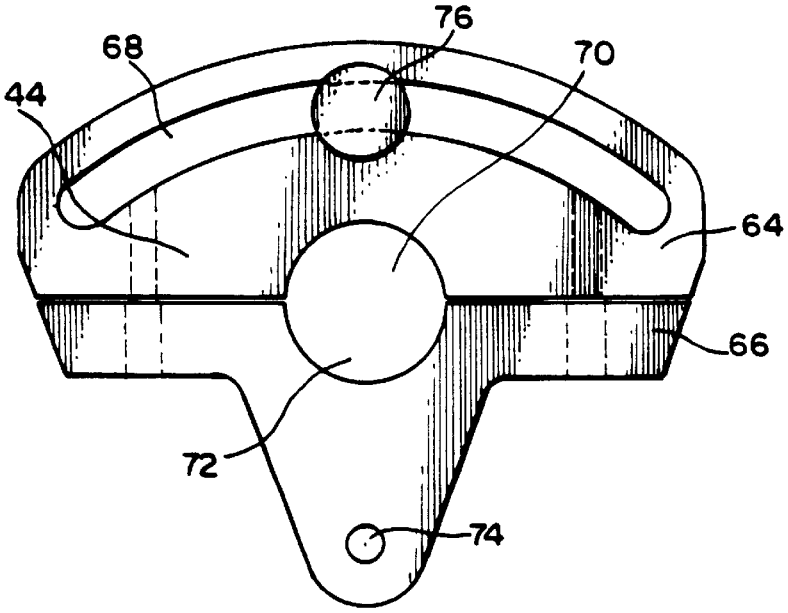
FIG. 6 is an isolated view of the pivot bracket depicted in FIG. 4.

Referring now to FIG. 6, member 44 will now be described. Member 44 includes two halves 64 and 66. Member 46 has an arcuate slot 68 formed therein and an opening 70. Member 66 also includes an opening 72. It is noted that while openings 70 and 72 are depicted as being semi-circular in shape they are not so limited. The only limitation for openings 70 and 72 is that they be appropriately shaped to firmly grip the body of clipping mechanism 50. Member 66 also has a bore 74 formed therein. This is the pivot point through which axis 48 passes and about which bracket 44, and thereby clipping mechanism 50, rotates. When member 44 is attached to member 42, via a bole or other suitable pivot pin, it is possible to pivot bracket 44, thereby pivoting mechanism 50, and maintain the relative position of the lead prong of the clipping blades. A bolt 76 is provided to hold bracket 44 in place against bracket 42. Bolt 76 passes through arcuate slot 68 and into the threaded receptacle 60.

Referring now to FIGS. 7–10, another aspect of the invention will be explained. As discussed above, one of the problems facing the automation of carpet pile carving was the undesirable temperatures the cutting blades would reach after extended use. This problem has been solved in the invention by a novel cooling structure. The cutting blade assembly 78 includes three basic components, a reciprocating blade 80, a fixed blade 82 and a manifold 84. The reciprocating action of blade 80 relative to blade 82 causes prongs 86, including leading prong 88, to cut carpet pile. Friction forces generated at contacting surfaces in the areas 90 and 92 cause heat to be generated. It is noted that blades 80 and 82 define an area or chamber 94 between them.

A number of bores 96 have been formed in fixed blade 82. Bores 96 are positioned to communicate with area or chamber 94, i.e, bores 96 establish fluid communication with chamber 94. Manifold 84 has a number of passages 98 formed therein. The ends of passages 98 are positioned to correspond with bores 96 when manifold 84 is mounted adjacent or on fixed blade 82. The end 100 of passages 98 is attached to a fluid supply (not shown). It is within the scope of the invention for a valve to be positioned between the fluid supply and end 100. It is also within the scope of the invention for such valve to be controlled by computer 14.

In the preferred embodiment, clipper mechanism 50 is a standard, hand operated air driven clipper. In such an embodiment a tap mechanism 102 (FIG. 4) bleeds a small amount of air from an air supply and diverts that air through appropriate hosing 104 and into end 100 in manifold 84. Air then passes though passages 98, through bores 96 and into area or chamber 94. Since the ends of chamber 94 are open, as shown in FIG. 10, the air passes out and away from the clipping blades. It has been found that such movement of air, between the clipping blades, removes excess heat generated as a result of the previously described friction forces.

Another aspect of the invention deals with the problem of tufts created due to deflection or compression of pile when the cutting blades are moved against the pile. It will be recalled from the above that the carrier platform is moved to desired locations in response to a control signal generated by computer 14. In addition, clipper head 50 is moved by the carrier platform onto the carpet pile so that the clipper head can be moved in a desired direction. Computer 14 in such instances is programmed to generate the control signals necessary for slightly moving the carrier platform, so that the control signals initially cause the clipper head to be moved a distance away from the point where the lead prongs are against the pile in a direction other than the intended direction of movement. As used herein the term slight is relative to the depth of the pile. The amount of movement needs to be sufficient to allow the pile to return to its natural shape, i.e., extending out. It is envisioned that such movement will total between ¼ to 1 inch. It is especially preferred for the clipper head to move a distance away in a direction substantially 180 degrees from the desired direction of movement.

Figure 11:
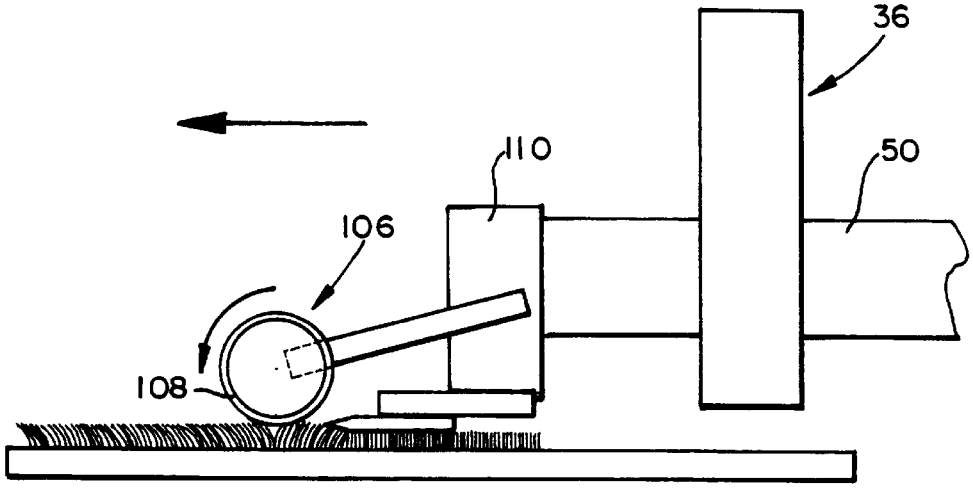
FIG. 11 is a diagrammatic view of a clipping head assembly constructed in accordance with the present invention, including a pile orientation mechanism.
Figure 12:
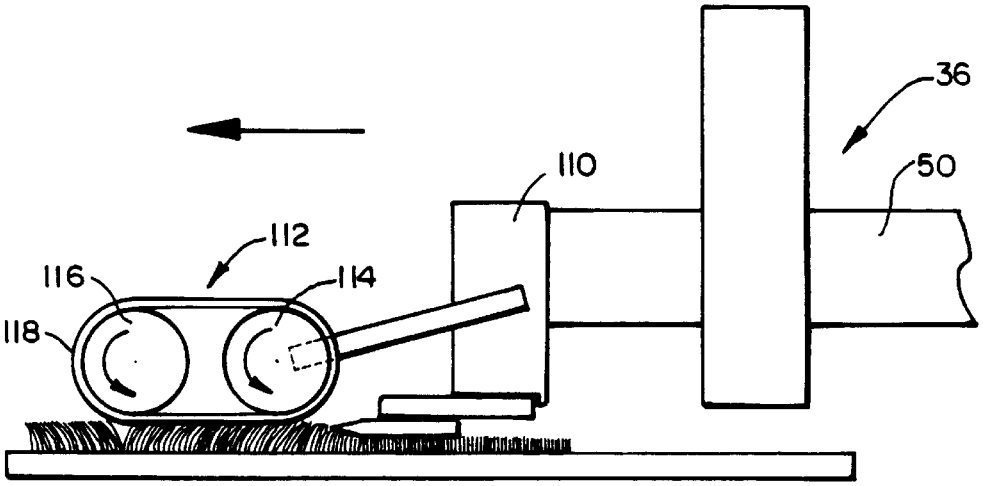
FIG. 12 is a diagrammatic view of a clipping head assembly constructed in accordance with the present invention, including an alternative embodiment of the pile orientation mechanism depicted in FIG. 11.

A still further aspect of the invention, addresses the problem identified above regarding random pile angle. Referring now to FIG. 11, an alternative embodiment of the invention is shown. A pile orientation member 106 is depicted for orienting pile in the path of the clipper head so that the pile is oriented in a plane substantially perpendicular to the cutting plane, i.e., the plane in which the cutting blades are cutting. As shown a friction engaging member, in this case a roller 108 frictionally engages the pile and orients it for the cutting blades. It is noted that roller 108 is driven by driver 110 to turn in a direction which pushes the pile towards the cutting blades. As shown in FIG. 12, the friction engaging member is belt assembly 112, wherein the assembly includes a pair of rollers 114, 116 about which extends a belt 118. Although two specific embodiments are shown, friction engaging member 106 can take any number of forms, for example, a drum, a brush, a elastic wheel or even a jet or flow of fluid.

While the invention has been described and illustrated with reference to specific embodiments, those skilled in the art will recognize that modification and variations may be made without departing from the principles of the invention as described herein above and set forth in the following claims.

What is claimed is:

1. A method of sculpting carpet by cutting carpet pile, wherein the cutting of said carpet pile is to begin at a point on said carpet pile and commence from the beginning point in a first direction, said method comprising:

providing a positioning carriage for positioning a carrier platform at desired locations in response to a control signal;

providing a carpet trimmer, attached to said carrier platform, wherein said carpet trimmer has a clipper head, wherein said clipper head is moved by said carrier platform onto said carpet pile so that said clipper head can be moved in a desired direction in response to the control signal; and providing a computer, and using said computer to control the carrier platform to:

position the clipper head to begin the cutting of said carpet pile at a point on said carpet pile, where the cutting is to commence from the beginning point in a first direction, said positioning causing the deflection or compression of said carpet pile;

firstly moving said positioned clipper head at the beginning point a distance away from said beginning point in a second direction in a plane generally parallel to said carpet and different from said first direction, said distance and the orientation of said second distance being selected to return said carpet pile to its original non-deflected, non-compressed state; and then secondly moving said clipper head in the first direction.

2. The method of claim wherein said computer controls the carrier platform to first move said positioned clipper head a distance away from said beginning point in said second direction substantially 180 degrees from said first direction.

* * * * *